US009601223B2

(12) United States Patent
Deych et al.

(10) Patent No.: US 9,601,223 B2
(45) Date of Patent: Mar. 21, 2017

(54) ANTI-SCATTER GRID OR COLLIMATOR

(75) Inventors: Ruvin Deych, Gloucester, MA (US); Ben Tuval, Burlington, MA (US)

(73) Assignee: Analogic Corporation, Peabody, MA (US)

( * ) Notice: Subject to any disclaimer, the term of this patent is extended or adjusted under 35 U.S.C. 154(b) by 1 day.

(21) Appl. No.: 13/386,278

(22) PCT Filed: Jul. 21, 2009

(86) PCT No.: PCT/US2009/051201
§ 371 (c)(1),
(2), (4) Date: Jan. 20, 2012

(87) PCT Pub. No.: WO2011/010995
PCT Pub. Date: Jan. 27, 2011

(65) Prior Publication Data
US 2013/0121475 A1 May 16, 2013

(51) Int. Cl.
*G21K 1/00* (2006.01)
*G21K 1/02* (2006.01)

(52) U.S. Cl.
CPC ..... *G21K 1/00* (2013.01); *G21K 1/025* (2013.01)

(58) Field of Classification Search
CPC ..... G21K 1/025; G21K 1/02; G21K 2201/067
USPC ..... 378/154, 149
See application file for complete search history.

(56) References Cited

U.S. PATENT DOCUMENTS 4,472,827 A 9/1984 Gabbay et al.
5,668,851 A 9/1997 Dobbs
5,745,548 A 4/1998 Dobbs et al.
5,753,917 A 5/1998 Engdahl
5,781,606 A 7/1998 Dobbs et al.
6,175,615 B1 1/2001 Guru et al.
6,362,479 B1 3/2002 Andreaco et al.
6,448,559 B1 9/2002 Saoudi et al.
6,934,354 B2 * 8/2005 Hoffman ..... 378/19
6,980,629 B1 12/2005 Hoheisel et al.
(Continued)

FOREIGN PATENT DOCUMENTS

GB 536449 5/1941

OTHER PUBLICATIONS

Notice of Allowance cited in related U.S. Appl. No. 12/691,358 dated Jan. 19, 2012.
(Continued)

*Primary Examiner* — Hoon Song
(74) *Attorney, Agent, or Firm* — Cooper Legal Group, LLC

(57) ABSTRACT

Anti-scatter plates are used to attenuate secondary radiation so that it is not detected by a detector array. However, anti-scatter plates often cast dynamic shadows on the detector array which results in noise in signals produced by the detector array. As disclosed herein, an anti-scatter grid comprises at least two anti-scatter plates. A percentage difference in the shadows cast by the first and the second anti-scatter plates is substantially zero (e.g., causing uniform percentage change in shadows cast on the detector array). Additionally, the shadows that are cast by the anti-scatter plates may be substantially static. In one embodiment, this is accomplished by having a top surface of an anti-scatter plate that has a transverse dimension that is less than a bottom surface of the anti-scatter plate.

19 Claims, 4 Drawing Sheets

(56) References Cited

U.S. PATENT DOCUMENTS

| | | | | |
|---|---|---|---|---|
| 7,141,812 | B2 | 11/2006 | Appleby et al. | |
| 7,609,804 | B2 | 10/2009 | Hoffman | |
| 2002/0003863 | A1* | 1/2002 | Ohkoda | 378/154 |
| 2004/0120464 | A1 | 6/2004 | Hoffman | |
| 2004/0227092 | A1* | 11/2004 | Ratzmann et al. | 250/367 |
| 2009/0039562 | A1 | 2/2009 | Freund et al. | |

OTHER PUBLICATIONS

Notice of Allowance cited in related U.S. Appl. No. 12/691,358 dated May 1, 2012.

International Search Report cited in related application No. PCT/US2009/051201 dated Mar. 24, 2010.

Vogtmeier; et al., "Two-dimensional Anti-Scatter-Grids for Computed Tomography Detectors", Medical Imaging 2008: Physics of Medical Imaging, edited by Jiang Hsieh, Ehsan Samei, Proc. of SPIE vol. 6913, 691359, (2008).

* cited by examiner

ANTI-SCATTER GRID OR COLLIMATOR

BACKGROUND

The present application applies to radiation scanners, such as computed tomography (CT) scanners. It finds particular application with the arrangement, or rather configuration, of anti-scatter collimators, including one- and two-dimensional types, within such scanners.

CT scanners typically comprise a radiation source and a detector array positioned on a diametrically opposing sides of a rotating gantry. During a scan of an object, the object is placed in an examination region of the scanner and the rotating gantry rotates about the object while radiation is emitted from a focal spot of the radiation source.

Radiation that impinges upon the object is attenuated as it traverses the object. Generally, highly dense objects attenuate more radiation than less dense objects. In this way, characteristics of the object, or rather internal aspects of the object, may be identified based upon the attenuation.

Radiation that traverses the object is detected by one or more pixels, or channels of the detector array and a signal is generated in response thereto. The signal is indicative of characteristics of the radiation that is detected by the pixel, and thus is indicative of the attenuation of the object in a particular projection. An image can be reconstructed from a set of projections, which represents density distribution within an object. In this way, an image may depict a high density object, such as a bone, surround by less dense tissue, for example.

In an ideal environment, the radiation that is detected by a pixel corresponds to attenuated radiation that strikes the pixel on a straight axis from the focal spot of the radiation source. This type of radiation is commonly referred to as primary radiation. Unfortunately, some of the radiation that impinges upon the object is scattered, and deviates from a straight path (e.g., due to inevitable interactions with an object). Scattered radiation that is detected by a pixel, commonly referred to as secondary radiation, increases noise and reduces the quality of an image produced based upon the detector signal. In diagnostic imaging, secondary radiation can account for as much as 90% or more of the total signal response that is generated by a pixel if no anti-scatter collimator is used.

In order to reduce the possibility of scattered radiation impacting a pixel of the detector array, anti-scatter collimators are commonly inserted between the examination region and the detector array. Anti-scatter collimators comprise anti-scatter plates configured to absorb scattered radiation and transmission channels configured to allow primary radiation to pass through the collimator and be detected by a pixel of the detector array. To promote capture of scattered radiation, the height (e.g., in a dimension extending from a detector to the radiation source) of the anti-scatter plates is generally larger that the width, or transverse dimension (e.g., in a dimension perpendicular to the height), of the transmission channels. This is commonly referred to as a high aspect ratio.

While the anti-scatter collimators have proven effective for capturing scattered radiation, anti-scatter plates impose "shadows" on the detector array. A pixel that is at least partially shadowed by an anti-scatter plate generates a signal which is reduced in strength relative to a signal from a non-shadowed pixel. A signal with a reduced strength can be corrected for if the shadow is substantially static. However, if the shadow is dynamic, the pixel may produce an unstable signal and cause artifacts to be produced in a resulting image.

A shadow may be dynamic for a plurality of reasons. For example, a dynamic shadow may be caused by focal spot motion due to thermal effects and/or from vibration caused during rotation of the radiation source. In another example, dynamic shadow is caused by bending of the anti-scatter plates. The long (e.g., 15 mm) and slender (e.g., 0.1 mm) design of the anti-scatter plates make them susceptible to bending during rotation. Further, the anti-scatter plates may be bent during the manufacturing process.

The effects of dynamic shadows may be reduced if the percentage change by respective pixels is uniform (e.g., a first shadow and a second shadow both increase by two percent). However, achieving a uniform percentage change has proven difficult for numerous reasons. For example, machine tolerances often cause the anti-scatter plates to not be aligned perfectly and/or cause the anti-scatter plates not to be the same width. Therefore, the spacing between anti-scatter plates may not be uniform and/or an anti-scatter plate may be positioned incorrectly relative to a pixel. Additionally, the anti-scatter plates may not bend uniformly so the percentage change may not be uniform. Therefore, it is difficult to reduce the effects of a dynamic shadow.

SUMMARY

Aspects of the present application address the above matters, and others. According to one aspect an anti-scatter grid is provided. The anti-scatter grid comprises a first anti-scatter plate, located above a first location on an underlying detector array, which is configured to cast a first shadow on the detector array when a focal spot is at a first position and a second shadow when the focal spot is at a second position. The anti-scatter grid also comprises a second anti-scatter plate, located above a second location on the underlying detector array, which is configured to cast a first shadow on the detector array when the focal spot is at the first position and a second shadow when the focal spot is at the second position. A percentage difference between the first and second shadows from the first anti-scatter plate and the first and second shadows from the second anti-scatter plate are substantially zero. Further, the first and second shadows cast by the first anti-scatter plate and the first and second shadows cast by the second anti-scatter plate have respective widths, or rather transverse dimensions, greater than respective widths of shadows cast by a third anti-scatter plate located above the first location and a fourth anti-scatter plate located above the second location.

According to another aspect, an apparatus is provided. The apparatus comprises an anti-scatter plate configured for positioning between an examination region and a detector array. The anti-scatter plate has a top surface and a bottom surface. The bottom surface has a greater surface area than the top surface.

According to yet another aspect an anti-scatter plate is provided. The anti-scatter plate comprises a stalk portion configured to attenuate at least some secondary radiation from impinging upon at least one element of a detector array. The anti-scatter plate also comprises a base portion that has a transverse dimension that is greater than a transverse dimension of the stalk portion and is configured to be situated between the detector array and the stalk portion.

According to another aspect, an apparatus is provided. The apparatus comprises an anti-scatter plate having a substantially trapezoidal shape. The anti-scatter plate is configured to attenuate at least some secondary radiation from impinging upon at least one pixel of a radiation detector array.

According to another aspect, a method is provided. The method comprises producing an anti-scatter grid for a radiation scanner. The anti-scatter grid has a top surface and a bottom surface. The bottom surface has a greater surface area than the top surface.

Those of ordinary skill in the art will appreciate still other aspects of the present application upon reading and understanding the appended description.

FIGURES

The application is illustrated by way of example and not limitation in the figures of the accompanying drawings, in which like references indicate similar elements and in which.

DESCRIPTION

Figure 1:
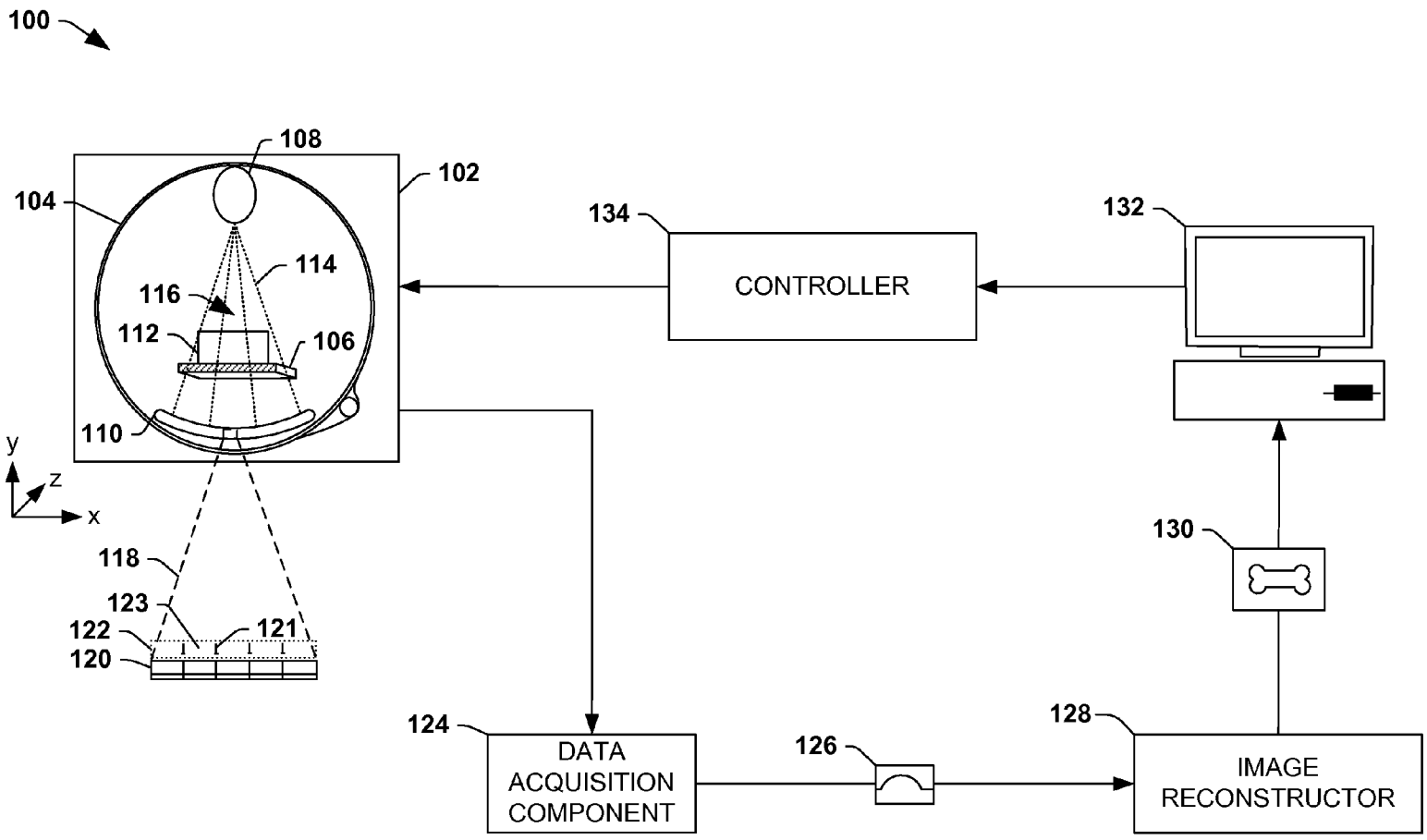
FIG. 1 depicts a schematic block diagram of an example scanner.

FIG. 1 depicts an example scanner 100. The scanner 100 may be useful in medical, security, or industrial applications, for example. As illustrated, the scanner 100 typically comprises an object scanning apparatus 102. The object scanning apparatus 102 may be a third generation computed tomography (CT) scanner that comprises a rotating gantry 104, and an examination surface 106, such as a bed or conveyor (e.g., going into and out of the page).

The rotating gantry 104 comprises a radiation source 108 (e.g., an x-ray tube) and a detector array 110 and is generally configured to rotate relative to the examination surface 106 about an axis of rotation perpendicular to the plane of the page (e.g., into/out of the page). During the rotation, the radiation source 108 emits in a fan, cone, wedge, or other shaped beam of radiation 114 that traverses an object 112 situated on the examination surface 106 in an examination region 116 of the object scanning apparatus 102. In this way, projections from a variety of perspectives of a leg, for example, can be collected from a scan of the object 112 to create a set of projections for the object 112. It will be appreciated that in another embodiment, the rotating gantry 104 is stationary and the object 112 is rotated.

Radiation 114 that traverses the object 112 is detected by the detector array 110. Targets within the object 112 may cause various amounts of radiation to traverse the object 112 (e.g., creating areas of the high traversal and areas of low traversal within the object 112). For example, less radiation may traverse targets with a higher density and/or a higher atomic number (relative to densities and atomic numbers of other targets in the object 112). In this way, a bone may appear more prominently in an image of the object 112 than surrounding tissue (which may be virtually invisible), since tissue is generally less dense than bone (e.g., more radiation traverses the tissue than the bone).

It will be appreciated that numerous compositions, or rather configurations, for the detector array 110 are known to those skilled in the art and may be suitable for the example scanner 100. For example, the detector array 110 may comprise a direct conversion detector material, such as a crystalline material (e.g., cadmium zinc telluride, cadmium telluride) and/or an amorphous photoelectric material. Alternatively, the detector array 110 may be a solid state detector comprised of scintillating crystals and a two-dimensional array of photodiodes configured to receive light photons generated by the scintillator in response to radiation 114 from the radiation source 108.

In the illustrated example, a portion of the detector array 110 is enlarged 118 to illustrate components of the detector array 110. The detector array 110 may comprise a plurality (e.g., generally between 16 and 24) of interchangeable detector elements 120 positioned to form an arcuate structure (e.g., 1 meter long). The elements 120 may be comprised of a plurality of pixels, or rather channels. In one example, respective elements comprise about fifty pixels. Respective pixels are configured to detect radiation and generate a signal, or rather pulse, in response thereto. It will be appreciated that where signals are substantially continuously emitted from respective pixels, the signals that are generated when radiation is detected may comprise different attributes (e.g., a higher amplitude) than baseline signals that are produced when no radiation is detected.

The detector array 110 also comprises an anti-scatter grid 122, which is configured to absorb, or otherwise alter, scattered radiation so that it is not detected by the pixels. In this way, scattered radiation, herein referred to as secondary radiation, does not contribute to noise in the signals produced by respective pixels. It will be understood to those skilled in that art that "secondary radiation" is used herein to refer to radiation that is scattered, or rather deflected, while it is traversing the object 112 and/or a portion of the object scanning apparatus 102 (e.g., the examination surface 106, a wall of the object scanning apparatus, etc.), whereas "primary radiation" is used herein to refer to radiation that travels along a substantially straight axis or direct trajectory path from the focal spot of the radiation source 108 to the detector array 110. While primary radiation is useful for generating an image of the object 112 under examination, secondary radiation may cause artifacts in a resulting image. Therefore, the purpose of the anti-scatter collimator is to absorb undesirable secondary radiation while not absorbing primary radiation.

It will be appreciated that in some applications, the anti-scatter grid 122 may not be part of the detector array 110, but rather selectively attached between the detector array 110 and the radiation source 108. In this way, the anti-scatter grid 122 may be manufactured separately from the detector array 110 and later secured to the detector array 110, for example. It will also be appreciated that while the anti-scatter grid 122 appears to be floating above the detector array 110, the anti-scatter grid may be mounted in any of a number of suitable manners (not shown), such as attached to edges of the detector array 110.

The anti-scatter grid 122 is comprised of a plurality of anti-scatter plates 121 (e.g., the needle-like objects protruding from the detector elements 120) and transmission channels 123 (e.g., gaps between the anti-scatter plates). As discussed with respect to FIGS. 6-7, the shape and/or orientation of the anti-scatter plates are configured to reduce the effect that dynamic shadowing caused by the anti-scatter plates may have on resulting images relative to shadowing caused by prior art anti-scatter plates. For example, the anti-scatter plates may have a thin stalk portion relative to a base portion so that the shadowed imposed by the anti-scatter plates on the detector array will be substantially constant.

It will be understood to those skilled in that art that the anti-scatter plates may be composed of molybdenum, tungsten, lead, and/or other material that has characteristics that make it able to absorb, or rather attenuate, radiation. The selected material may also have a high tensile strength so that it does not bend easily when manufactured to a thin thickness (e.g., 0.1-0.2 mm).

Signals that are produced by the detector array 110, or rather the pixels of the detector array 110, are transmitted from the detector array 110 to a data acquisition component 124 configured to compile signals that were transmitted within a predetermine time interval, or rather measurement interval. It will be appreciated that this measurement interval may be referred to as a "view" and generally reflects signals generated from radiation that was emitted while the radiation source 108 was at a particular angular range relative to the object 112. Based upon the compiled signals, the data acquisition component 124 may generate projection data 126 indicative of the compiled signals.

Projection data 126 generated by the data acquisition component 124 may be transmitted to an image reconstructor 128 configured to generate image data 130 from the projection data 126 using a suitable analytical, iterative, and/or other reconstruction technique (e.g., backprojection reconstruction, tomosynthesis reconstruction, etc.). In this way, the projection data 126 may be converted into a format that may be more useful for viewing an image of the object 112 under examination. It will be appreciated that secondary radiation that was not absorbed by the anti-scatter grid 122 and detected by the pixels may cause artifacts (e.g., dark or light spots) in the image data 130 and/or may reduce the quality of the image data 130 (e.g., making it difficult for a human observer to view a portion of the object 112 depicted in the image data 130).

The image data 130 may be presented in human perceptible form on a monitor 132 for human observation. In one embodiment, the monitor 132 displays a user interface, and a computer, connected to the monitor 132, is configured to receive human input. The received input may be transmitted to a controller 134 configured to generate instructions for the object scanning apparatus 102. For example, a doctor may want to view a higher resolution image of the object 112, and the controller 134 may thus instruct the object scanning apparatus 102 to rescan the object 112.

Figure 2:
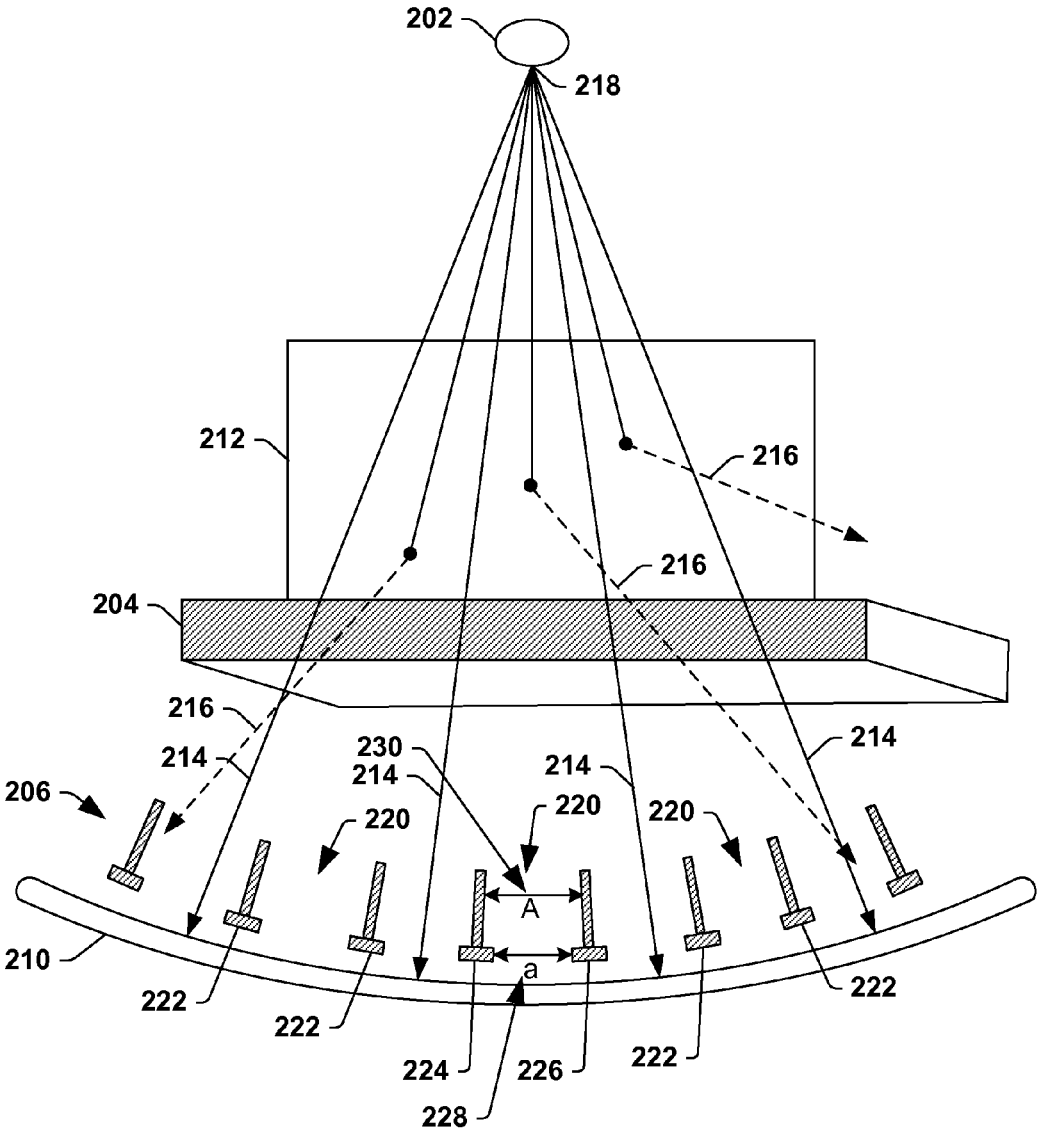
FIG. 2 depicts a zoomed in view of a portion of an object scanning apparatus.

FIG. 2 illustrates a zoomed in view of a portion of an object scanning apparatus 200 (e.g., 102 in FIG. 1). The object scanning apparatus comprises a radiation source 202 (e.g., 108 in FIG. 1), an examination surface 204 (e.g., 106 in FIG. 1), an anti-scatter grid 206 (e.g., 122 in FIG. 1), and a detector array 210 (e.g., 110 in FIG. 1).

During an examination, an object 212 is placed on the examination surface 204 (e.g., a bed, conveyor belt, etc.) and radiation emitted from the radiation source 202 traverses the object 212. The radiation is considered to be primary radiation 214 or secondary radiation 216 based upon its trajectory after exiting the radiation source 202. Radiation that follows a substantially straight axis from a focal spot 218 of the radiation source 202 to the detector array 210 is referred to as primary radiation 214. Radiation that is somehow deflected (e.g., causing the axis not to be straight) is referred to as secondary radiation 216. In the illustrated example, the radiation is deflected by the object 212.

It will be appreciated that it is undesirable for the detector array 210 to detect secondary radiation 216 because it may produce artifacts in an image produced based upon the radiation that is detected by the detector array 210. Stated differently, images are produced by correlating the projection data with a position of the radiation source 202 at the time radiation associated with the projection data was emitted. It is assumed that the detected radiation traveled along a straight axis from the position of the radiation source 202 to the pixel of the detector array 210 that detected the radiation. However, secondary radiation does not follow this assumption. Therefore, during image reconstruction, the secondary radiation can cause artifacts.

The anti-scatter grid 206, such as a 1D or 2D anti-scatter collimator, is configured to reduce the probability that secondary radiation 216 will be detected by the detector array. The anti-scatter grid 206 comprises a plurality of transmission channels 220 configured to allow primary radiation 214 to traverse the anti-scatter grid 206, and a plurality of anti-scatter plates 222 configured to absorb, or otherwise attenuate, the secondary radiation 216 so that it is not detected by the detector array.

The anti-scatter plates 222 are also configured to reduce dynamic shadowing and/or reduce the effect of dynamic shadowing on an image relative to the anti-scatter plates of anti-scatter grids well known to those skilled in the art. That is, the anti-scatter plates are configured to impose static shadows and/or impose shadows that change uniformly (e.g., a percentage change in a first shadow generated from a first anti-scatter plate is similar to a percentage change in a second shadow generated by a second anti-scatter plate).

In one embodiment, a first anti-scatter plate 224 located above a first location on an underlying detector array 210 is configured to cast a first shadow on the detector array 210 when the focal spot 218 is at a first position and a second shadow when the focal spot 218 is at a second position. Similarly, a second anti-scatter plate 226 located above a second location on the underlying detector array 210 is configured to cast a first shadow on the detector array when the focal spot 218 is at the first position and a second shadow when the focal spot is at the second location. It will be appreciated that as used herein, the term "shadow" is used herein in a broad sense to describe a portion of the detector array 210 that cannot receive radiation because of an anti-scatter plate. Generally, the shadowed portion of the detector array 210 includes a portion of the detector array directly below an anti-scatter plate 222 and a portion of the detector array adjacent to the portion of the detector array directly below the anti-scatter plate 222. It will be appreciated that for illustrative purposes, the discussion has been limited to a discussion of a first 224 and second 226 anti-scatter plate. However, the anti-scatter grid 206 may comprise a plurality (e.g., 1000) of anti-scatter plates, and the concepts herein described are intended to apply to the plurality of anti-scatter plates. For example, a third anti-scatter plate may be positioned above a third location on the underlying detector array 210 and a fourth anti-scatter plate may be positioned above a fourth location. Each anti-scatter plate may also cast a respective shadow on the underlying detector array 210.

The first and second anti-scatter plates 224 and 226 are configured such that a percentage difference between the first and second shadows from the first anti-scatter plate 224 and the first and second shadows from the second anti-scatter plate 226 are substantially zero. That is, the shadows cast by the first anti-scatter plate 224 and the shadows cast by the second anti-scatter plate 226 have substantially zero percentage change. As discussed below with respect to FIGS. 6-7 the first and second shadows cast by the first anti-scatter plate 224 and the first and second shadows cast by the second anti-scatter plate 226 have widths, or rather transverse dimensions, that are greater than prior art anti-scatter plates (e.g., third and fourth anti-scatter plates) positioned about the first and second locations on the underlying detector array 210.

Figure 3:
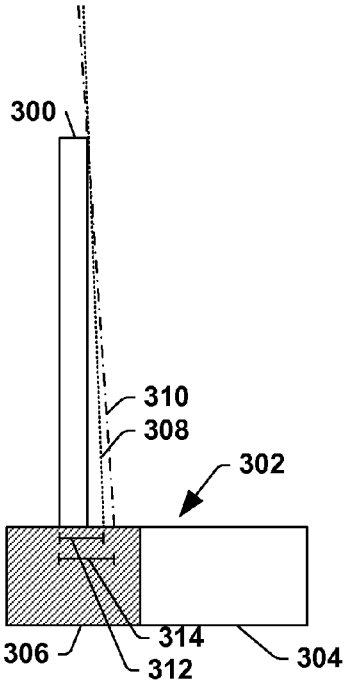
Fig. 3 (Prior Art)
FIG. 3 illustrates a prior art anti-scatter plate.

FIG. 3 illustrates a prior art anti-scatter plate 300. The anti-scatter plate 300 is situated in a plane substantially perpendicular to a plane formed by the surface of a detector array 302 (e.g., a horizontal plane) and is centered about a gap 306, or rather a dead zone of the detector array 302 (e.g., an area of the detector array 302 that does not comprise detecting pixels). Adjacent to the gap 306 is a pixel 304, or rather channel, of the detector array 302. In one example, the gap 306 has a transverse dimension of between 0.2 and 0.3 mm, and the pixel 304 has a transverse dimension of between 0.5 and 1.0 mm.

It will be appreciated that the term "height" is used herein to describe a dimension substantially perpendicular to a plane formed by the top surface of the detector array 302, and the term "transverse" is used herein to describe a dimension substantially parallel to a plane formed by the top surface of the detector array 302.

The anti-scatter plate 300 has a high aspect ratio. That is, the anti-scatter plate 300 has a height that is greater than its transverse dimension. In one example, the anti-scatter plate 300 has a height dimension of 15 mm and a transverse dimension of 0.1 mm.

The anti-scatter plate 300 casts a shadow on the detector array 302. It will be appreciated that the shadow is defined by a portion of the detector array that is unable to receive primary radiation because of the position of the anti-scatter plate 300 relative to a focal spot (e.g., 218 in FIG. 2) of a radiation source (e.g., 202 in FIG. 2). In the illustrated example, the transverse boundaries of a shadow are defined by a left edge of the anti-scatter plate 300 and a ray of primary radiation that travels near the anti-scatter plate 300 but is capable of being detected by the detector array 302. Two rays of primary radiation are illustrated. A first ray 308 (e.g., represented by a dotted line) is emitted from the focal spot while the focal spot is at a first location and defines the boundary of a first shadow (represented by line 312). A second ray 310 (e.g., represented by a dash-dotted line) is emitted from the focal spot while the focal spot is at a second location and defines the boundary of a second shadow (represented by line 314), or rather a change in the boundaries of the first shadow.

It will be understood to those skilled in the art that the focal spot may move from the first location to the second location because of focal spot motion caused by thermal expansion/contraction and/or vibration during a rotation about an object under examination. Generally, the distance between the first and second location is less than 1 mm.

As illustrated, the transverse dimension of the first shadow 312, created while the focal spot is at the first location, is less than the second shadow 314, created while the focal spot is at the second location. A shadow that changes dimensions is generally known in the art as a dynamic shadow. The difference between the transverse dimensions of the first 312 and second 314 shadows may be referred to as a percentage change in the shadow.

It will be appreciated that in the illustrated example, the percentage change may be immaterial because both the first 312 and the second 314 shadows are imposed upon the gap 306 of detector array 302 rather than the pixel 304. That is, a signal, which is produced by the pixel 304, may be unchanged by either the first 312 or the second 314 shadows. In an ideal environment (e.g., where anti-scatter plates are perpendicular to the detector array and centered on gaps in the detector array 302), a shadow and/or a change in transverse dimension of a shadow would not affect signals produced by pixels adjacent to the anti-scatter plates.

In practicality, it is difficult to position anti-scatter plates perpendicular to the detector array 302 and/or to center anti-scatter plates on gaps in the detector array 302 because of mechanical error, for example. Additionally, the anti-scatter plates may intentionally not be centered on the gap 306. In one example, the anti-scatter plates are instead respectively positioned centered on a portion of the pixels having a higher sensitivity to radiation relative to other portions of the pixels. However, placement of the anti-scatter plates is still a challenge because of the precision necessary for the plates to be effective and not significantly affect the signals produced by the pixel (e.g., within 0.05 mm of its intended location).

Figure 4:
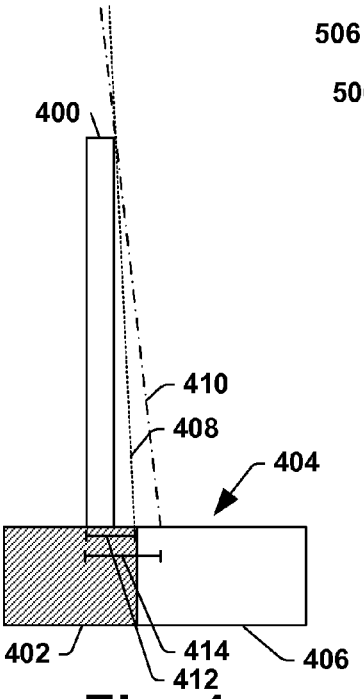
Fig. 4 (Prior Art)
FIG. 4 illustrates a prior art anti-scatter plate.

FIG. 4 illustrates a prior art anti-scatter plate 400 (e.g. that is not centered on a gap 402 of a detector array 404 (e.g., 302 in FIG. 3), because of machine error, for example. While the position of the anti-scatter plate 400 may be within mechanical position tolerances, or rather an x-position tolerance, it may cause variances in a shadow cast by the anti-scatter plate 400 relative to a shadow cast by an anti-scatter plate that is centered on the gap 402 (e.g., as illustrated in FIG. 3).

Similar to those illustrated in FIG. 3, FIG. 4 illustrates two rays of primary radiation indicative of a transverse boundary of a shadow. A first ray 408 (e.g., represented by a dotted line) is emitted from the focal spot (e.g., 218 in FIG. 2) while the focal spot is at the first location and defines the boundary of a first shadow (represented by line 412). A second ray 410 (e.g., represented by dash-dotted line) is emitted from the focal spot while the focal spot is at the second location and defines the boundary of a second shadow (represented by line 414). As illustrated, the second shadow 414 is imposed on an adjacent pixel 406. Therefore, a signal generated by the pixel 406 would change when the location of the focal spot moved from the first location to the second location, and may cause an artifact on an image resulting from the signal.

Comparing the shadows cast by the anti-scatter plate in FIG. 3 with the shadows cast by the anti-scatter plate in FIG. 4, it will be appreciated that there is a difference in the percentage change of the signals in channels related to anti-scatter plate 300 illustrated in FIG. 3 and the signals in channels for the anti-scatter plate 400 illustrated in FIG. 4. Stated differently, the dynamic change of the signals caused by focal spot motion would not be a uniform percentage change across anti-scatter plates if the anti-scatter plate 300, illustrated in FIG. 3 and the anti-scatter plate 400, illustrated in FIG. 4. For example, the shadow of the anti-scatter plate 300, illustrated in FIG. 3, may not cause any change in signal when focal spot moves to the left (e.g., as illustrated by the second ray 310), and the shadow of the anti-scatter plate 400, illustrated in FIG. 4, may decrease the signal by 10% due to shadowing when the focal spot moves to the left (e.g., as illustrated by the second ray 410).

While an image reconstructor and/or a data acquisition component may account for dynamic shadowing if there is uniform percentage change, artifacts may occur in an image produced from the signals emitted from the pixel illustrated in FIG. 3 and the pixel illustrated in FIG. 4 when there is not a uniform percentage change. Stated differently, even if the shadow from the anti-scatter plate 300 illustrated in FIG. 3 cast a shadow on the adjacent pixel 304, the percentage change in the shadow would differ from the percentage change of a shadow cast by the anti-scatter plate 400 illustrated in FIG. 4. Therefore, the image reconstructor may have difficulty distinguishing the shadows cast by the anti-scatter plates 300 and 400 from primary radiation that impinges the respective pixels 304 and 406.

It will be appreciated that even without focal spot motion (e.g., the focal spot remains at the first location during the duration of a scan), an anti-scatter plate that is not centered on a gap may impose a shadow on a pixel and affect a signal produced by the pixel. For example, if the anti-scatter plate is positioned on the edge of the gap but still within tolerances, a shadow may be imposed on the pixel. Similarly, if the gap is narrower than the gap 402 illustrated in FIG. 4, which may be preferred so that additional primary radiation is detected by the pixel 406, the shadow of an anti-scatter plate 400 not centered on the gap 402 may be imposed on the pixel 406.

Figure 5:
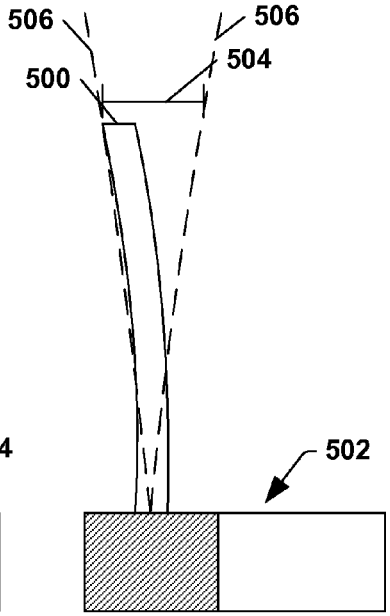
Fig. 5 (Prior Art)
FIG. 5 illustrates a prior art anti-scatter plate.

FIG. 5 illustrates a prior art anti-scatter plate 500 that is unintentionally bent. Anti-scatter plates may be bent during manufacturing of the plate and/or may be bent while an anti-scatter grid rotates during an examination of an object. It will be appreciated that for a bend to be acceptable during manufacturing, the bend must be within an orientation tolerance 504. In the illustrated example, the boundaries of an orientation tolerance 504 are represented by dashed lines 506.

Bending of the anti-scatter plate 500 may affect the shadow that is casted by the anti-scatter plate 500. For example, depending upon the placement of the anti-scatter plate 500 relative to the focal spot, the shadow that is cast by the bent anti-scatter plate 500 may be greater than or less than a shadow cast by an anti-scatter plate that is perpendicular to the surface of the detector array 502 (e.g., the anti-scatter plate 300 in FIG. 3). In the illustrated example, the shadow that is cast would have a transverse dimension that is less than the transverse dimension of a shadow cast by a perpendicular anti-scatter plate if the focal spot is to the left of the bent anti-scatter plate 500 and would have a greater transverse dimension if the focal spot is to the right of the bent anti-scatter plate 500.

Similarly, the percentage change in a shadow cast by the anti-scatter plate 500 may be different than the percentage change of a shadow cast by an anti-scatter plate that is perpendicular to the surface of the detector array 502. In the illustrated example, the percentage change in the shadow cast by the anti-scatter plate 500 would be greater than the percentage change in a shadow cast by a perpendicular anti-scatter shadow if the focal spot moved right and would by less than the percentage change in a shadow cast by a perpendicular anti-scatter shadow if the focal spot moved left.

Figure 6:
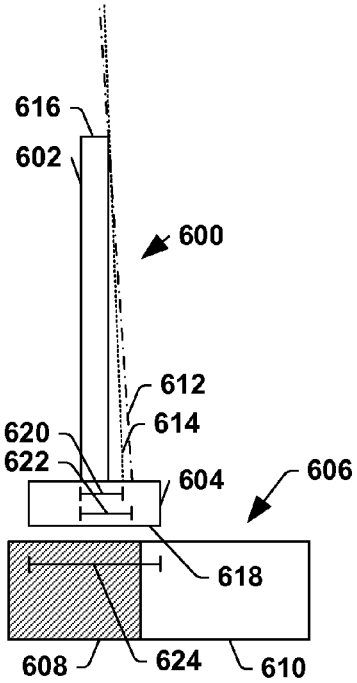
FIG. 6 illustrates an anti-scatter plate having a base portion with a greater transverse dimension than a transverse dimension of a stalk portion of the anti-scatter plate.

FIG. 6 illustrates one embodiment for reducing dynamic shadowing, or rather reducing the effect of dynamic shadowing (e.g., by causing respective shadows associated with a plurality of anti-scatter plates to change uniformly). An anti-scatter plate 600 (e.g., 222 in FIG. 2) comprises a stalk portion 602 and a base portion 604. The base portion 604, which is generally situated between the detector array 606 (e.g., 210 in FIG. 2) and the stalk portion 602, has a greater transverse dimension than the transverse dimension of the stalk portion 602. Stated differently, the anti-scatter plate 600 comprises a bottom surface 618 that has a greater transverse dimension and/or a greater surface area than a top surface 616 adjacent an examination region (e.g., 116 in FIG. 1) of a scanner (e.g., 100 in FIG. 1). It will be appreciated that by grouping a plurality of anti-scatter plates similar to the anti-scatter plate 600, an anti-scatter grid (e.g., 206 in FIG. 2) may be formed that has a bottom surface area that is greater than a top surface area.

The ratio of the transverse dimension and/or height dimension of the stalk portion 602 to the transverse dimension of the base portion 604 may be a function of the height of the stalk portion 602, the anticipated distance that the focal spot may move during an examination, and/or the orientation tolerance for the stalk portion 602. In one example, the stalk portion 602 has a transverse dimension of 0.1 mm and an height of 15 mm, whereas the base portion 604 has a transverse dimension of 0.3 mm and an height of 1 mm.

The base portion 604 is configured to receive shadows cast by the stalk portion 602 of the anti-scatter plate. In the illustrated example, two shadows are illustrated. A first shadow (represented by line 620) has a transverse dimension that extends from the anti-scatter plate 600 to a point on the base portion 604 whereon a first ray 614, emitted while a focal spot (e.g., 218 in FIG. 2) is at a first location, impinges. A second shadow (represented by line 622) has a transverse dimension that extends from the anti-scatter plate 600 to a point on the base portion 604 whereon a second ray 612, emitted while the focal spot is at a second location, impinges. Because the base portion 604 has a transverse dimension greater than the transverse dimensions of respective shadows cast by the stalk portion 602, dynamic shadows caused by focal spot motion may not be detected by the detector array 606, or rather a pixel Inposelstart610Inposelend of the detector array 606. In this way, dynamic shadows from the stalk portion 602 may not cause noise in a signal generated by the pixel 610.

While shadows cast from the stalk portion 602 impinge the base portion 604, a shadow from the base portion 604 (represented by line 624) may impinge the detector array 606. Similar to the prior art, a portion of the shadow 624 that impinges a gap 608 of the detector array 606 is immaterial because the gap 608 does not generate signals. While a portion of the shadow 624 that impinges on a pixel 610 of the detector may be detected, it would have minimal affect on an image because the shadow 624 would be substantially static. That is, the shadowed pixel may not detect changes in the shadow 624 and, in response to a detected change, generate a change in the signal generated by the pixel. In one example, the detector array 606, a data acquisition component (e.g., 124 in FIG. 1), and/or an image reconstructor (e.g., 128 in FIG. 1) may be calibrated in view of the substantially static, or rather constant, shadow. In this way, portions of a signal related to a shadowed portion of a pixel may be ignored and/or portions of a pixel that are constantly shadowed may be shut off, for example.

It will be appreciated that the substantially static shadow 624 may move slightly because of focal spot motion. However, a change in the shadow 624 cast by the base portion 604 because of focal spot motion may be minimal relative to a change in the shadow cast by the stalk portion 602 (from the first shadow 620 to the second shadow 622) and/or a change in the shadow of a prior art anti-scatter plate (e.g., 304 in FIG. 3). In one example, the change in a shadow cast by the base portion 624 is one-fifteenth of the change in shadow cast by the stalk portion because a height of the stalk portion is fifteen times great than the a height of the base portion. It will be understood by those skilled in the art that such a minimal change in the shadow 624 may have little to no affect on an image produced from a signal generated by the shadowed pixel, particularly where the pixel is a part of a third generation CT scanner. In one example, the signal change produced by a prior art anti-scatter collimator shadow is approximately 0.15% for a 0.1 mm focal spot motion, while the signal change produced by shadows of an anti-scatter collimator disclosed herein may be approximately 0.01%, for example.

It will be appreciated that the x-position tolerance (e.g., discussed with respect to FIG. 4) may be increased (e.g., permitting less precision) relative to the x-tolerance of prior art anti-scatter plates because the shadow that impinges the detector is substantially constant. For example, if the base portion 604 is positioned partially above the pixel 610 as illustrated in FIG. 6, the pixel will detect a substantially static shadow 624 and will emit a reduced signal relative to a signal that would be emitted if there were no shadow. Because the shadows cast by the stalk portion 602 (the first 620 and second 624 shadows) impinge the base portion 604 rather than the detector array 606, the detector array will not detect changes in the shadow, and therefore, the alignment of anti-scatter plates is less important than the alignment of anti-scatter plates in the prior art.

The base portion 604 may also lessen the effect of shadows caused by bent anti-scatter plates (e.g., as discussed with respect to FIG. 5). That is, shadows cast by a bent stalk portion may impinge upon the base portion 604 rather than the detector array 606. Therefore, changes in shadows cast by a bent anti-scatter plate relative to changes in shadows cast by a non-bent anti-scatter plate on the same detector array do not affect resulting images. It will be appreciated that the allowable orientation tolerance may be a function of the transverse dimension of the base portion 604 and/or vice-versa (e.g., ensuring that shadows cast by a bent stalk portion actually impinge the base portion 604 rather than the detector array 606).

It will be understood to those skilled in that art that other geometric shapes of an anti-scatter plate having a bottom surface with a greater surface area than the top surface area are also contemplated. For example, the anti-scatter plate may have a trapezoidal shape and/or a pyramidal shape.

Figure 7:
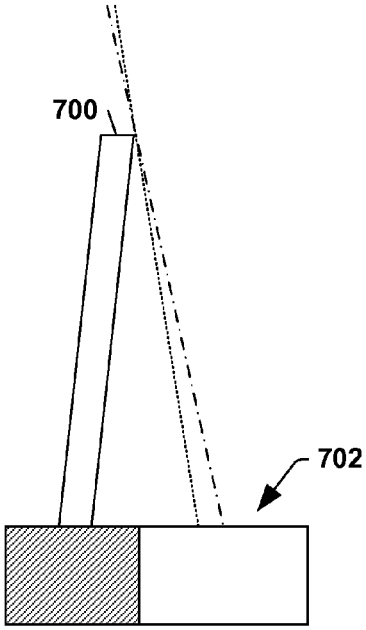
FIG. 7 illustrates an anti-scatter plate that is tilted relative to a detector array.

FIG. 7 illustrates another embodiment for reducing dynamic shadowing, or rather reducing the effect of dynamic shadowing (e.g., by causing respective shadows associated with a plurality of anti-scatter plates to have a uniform percentage change). More particularly, it illustrates an anti-scatter plate 700 (e.g., 222 in FIG. 2) that is angled relative to a detector array 702 (e.g., 210 in FIG. 2). The angle of the anti-scatter plate is greater than or equal to the orientation tolerance (e.g., 504 in FIG. 5). For example, if the orientation tolerance for bending is 0.5 degrees left and right of perpendicular relative to the surface of the detector array, the anti-scatter plate should have an angle equal to or greater than one degree.

The motion of a focal spot (e.g., 218 in FIG. 2) may also be considered in determining the angle of the anti-scatter plate. For example, anti-scatter plates may be tilted further away from perpendicular to the surface of the detector array if it is predicted that the focal spot may move by 1 mm as compared with the tilt of the anti-scatter plates if it is predicted that the focal spot may move by 0.5 mm.

If an anti-scatter grid is composed of a plurality of anti-scatter plates similar to the anti-scatter plate 700, the percentage change (e.g., when the focal spot moves) in shadows cast by the respective anti-scatter plates may be substantially equal. That is, the angled anti-scatter plates cause the percentage change of shadows from a plurality of anti-detector plates to be substantially equal. Because uniform percentage changes in shadows are less likely to produce artifacts in an image than non-uniform percentage changes, an image produced from an object scanning apparatus with angled anti-scatter plates may be better than an image produced by an object scanning apparatus with non-angled plates (e.g., as illustrated in FIG. 3).

Figure 8:
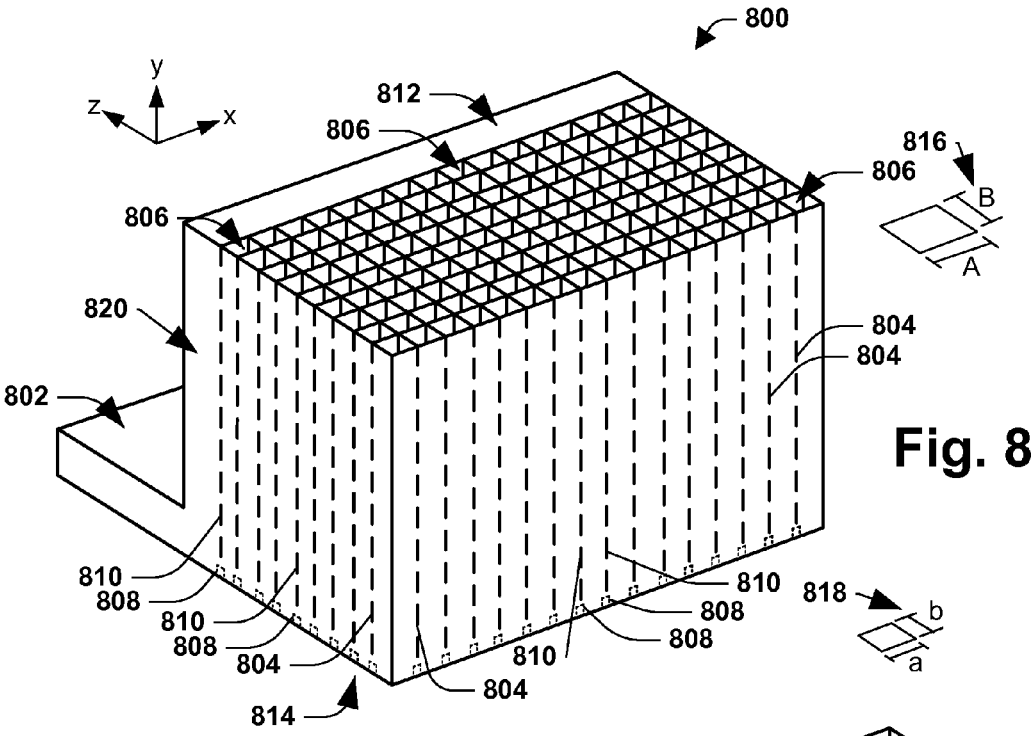
FIG. 8 illustrates a three-dimensional view of an example anti-scatter grid.
Figure 9:
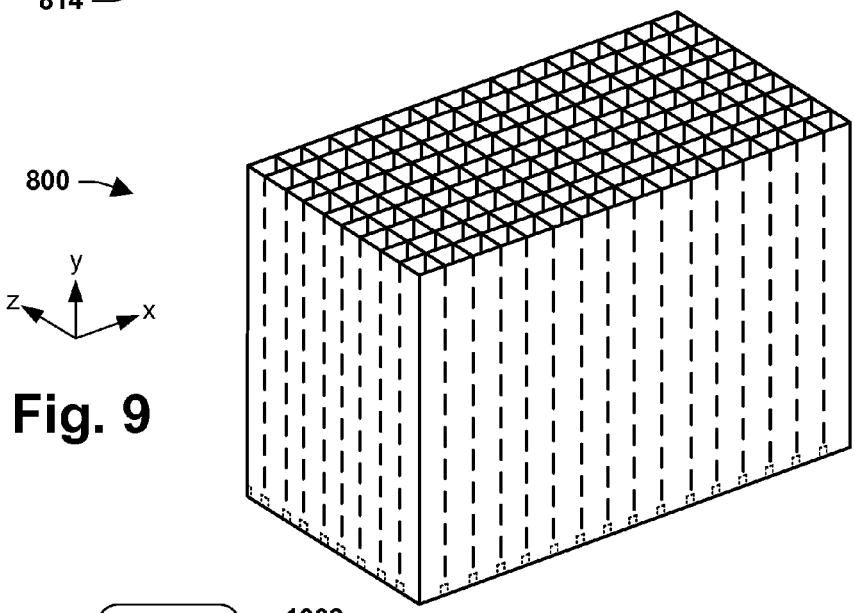
FIG. 9 illustrates a three-dimensional view of an example anti-scatter grid.

FIG. 8 represents a three-dimensional view of a two-dimensional anti-scatter grid 800 (e.g., 206 in FIG. 2). As illustrated, the two-dimensional anti-scatter grid 800 extends in an x-direction and in a z-direction (e.g., extending in a plane parallel to a plane formed by a detection surface of the detector array). Such a grid 800 may be positioned above an underlying detector array (e.g., 106 in FIG. 1) and (optionally) attached to the underlying detector array through an attachment edge 802 (and an attachment wall 820) of the anti-scatter grid 800, for example. It will be appreciated that as depicted in FIG. 9, in another embodiment, the grid 800 may not comprise an attachment edge 802 and/or the attachment wall 820, and the anti-scatter grid 800 may be secured to the underlying detector array and/or to another portion of an object scanning apparatus (e.g., 102 in FIG. 1) through a different fastening mechanism (e.g., brackets extending from the anti-scatter grid to the detector array).

Returning to FIG. 8, the anti-scatter grid 800 comprises a plurality of plates 804 (e.g., represented by dotted and dashed lines) that are configured to attenuate secondary radiation. Primary radiation is configured to travel through openings 806 between anti-scatter plates 804. In this way, the primary radiation may pass unimpeded through the anti-scatter grid 800 and be detected by the underlying detector array.

The anti-scatter plates have respective base portions 808 extending in the x and z-direction (represented by dotted lines) that protrude from a stalk portion 810 (e.g., represented by dashed lines) of the anti-scatter grid. Stated differently, the base portions 808 have greater x and z-dimensions than respective stalk portions 810. In this way, an opening 816 at a top surface 812 may be larger than an opening 818 at the bottom surface. In the illustrated example, the x-dimension (e.g., "A") and the z-dimension (e.g., "B") of the top opening 816 is larger than the x-dimension (e.g., "a") and the z-dimension (e.g., "b") of the bottom opening 818 that is nearer a detector array. It will be appreciated that the openings 816 and 818 are not to scale with the openings 806 of the anti-scatter grid 800.

Referring to FIG. 2, it may be better understood why the x-dimension of the top opening 816 is larger than the x-dimension of the bottom opening 818. In FIG. 2, the x-dimension (e.g., "a") of the transmission channel 220 (e.g., the opening) at a point 228 closer to the detector array 210 is smaller than the x-dimension (e.g., "A") at a point 230 that is further from the detector array 210. Stated differently, the anti-scatter plate is larger in the x-dimension at the point 228 than it is at point 230. Similarly, the z-dimension (not shown) of the transmission channel 220 at a point close to the detector array 210 may be smaller than the z-dimension at a point that is further from the detector array 210.

Returning to FIG. 8, because of the difference in dimensions, a top surface area 812 of the anti-scatter grid 800 may be less than a bottom surface area 814 adjacent the underlying detector array. It will be appreciated in another embodiment, the base portions 808 may have the same x-dimension as the stalk portions 810, but the z-dimension of the base portions 808 may be greater than the z-dimensions of the stalk portions 810. In this way, the base portions 808 may reduce the effects (e.g., dynamic shadowing) of focal spot motion (which generally occurs in the z-direction) while mitigating the amount of primary radiation that is attenuated by the anti-scatter grid. In yet another embodiment, the x-dimensions of the base portions 808 may be greater than the x-dimensions of the stalk portions 810, but the z-dimensions of the base portions 808 may be equal to the z-dimensions of the stalk portions 810.

Figure 10:
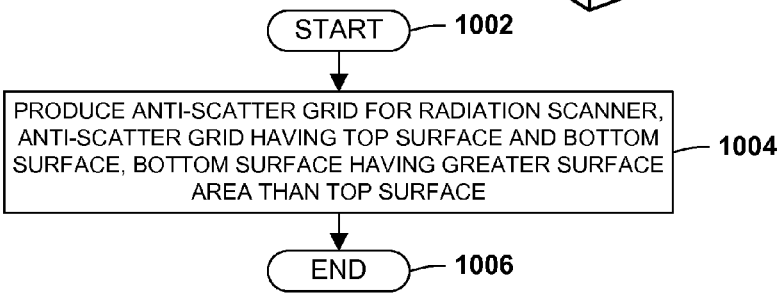
FIG. 10 is a flow diagram illustrating an example method for producing an anti-scatter grid.

FIG. 10 illustrates a method 1000 for producing an anti-scatter grid. The method begins at 1002, and an anti-scatter grid for a radiation scanner is produced at 1004. A bottom surface of the anti-scatter grid has a greater surface area than a bottom surface. It will be appreciated that the surface area refers to a portion of the surface that comprises a substrate, or other solid material. The surface area generally does not include porous portions of the surface, such as transmission channels and/or other holes in the surface.

In one embodiment, production includes shaping a mold to a predefined specification for the anti-scatter grid. For example, the specifications may include the intended height of anti-scatter plates that are part of the anti-scatter grid, base widths of the anti-scatter grid, and/or stalk widths of the anti-scatter grid. The mold may be made of plastic, metal, and/or other composition that is durable, easily shaped, and/or capable of receiving/containing a substrate. It will be understood to those skilled in the art that the surface of the mold may be coated with a non-stick substance that allows a harden substrate to be removed from mold.

After the mold is shaped, a substrate, such as tungsten filled epoxy, lead filled epoxy, and/or another substrate that is capable of attenuating radiation (e.g., a substrate with a high atomic number) may be injected into the molding and allowed to harden. Once hardened that mold may be separated from the substrate, and the substrate may be further refined to improve the shape and/or performance of the substrate as an anti-scatter grid. For example, the substrate may be cleaned to remove residue and/or portions of the hardened substrate may be trimmed to remove excess substrate (e.g., caused by seams in the mold).

It will be appreciated that in one embodiment, the anti-scatter grid is made in layers that are later combined to form the anti-scatter grid. For example, a lower layer (e.g., that is closest to the detector array) may have smaller openings (e.g., to allow primary radiation to pass through) than subsequent layers, where the subsequent layers have (gradually) larger openings, for example, so that the resulting arrangement provides a plurality of apertures that decrease in size, volume, etc., moving in the direction from the source to the detector (e.g., forming an inverted cone). In this manner, three-dimensional "stepped" or "tiered" formations that result from the layering provide for the plurality of narrowing apertures. In another example, the anti-scatter grid is not made in layers but rather the mold comprises crevices that flare in at one end such that the substrate poured into the mold forms a conical or trapezoid shape with a larger opening in a portion of the grid nearer a radiation source and a smaller opening nearer a detector array when the anti-scatter grid is mounted to the detector array.

Coupling devices that allow the anti-scatter grid to a detector array of an object scanning apparatus may then be attached to the anti-scatter grid. In one example, the coupling comprises includes a metal frame that surrounds four sides of the anti-scatter grid. In another example, the coupling device comprises locking mechanism (e.g., screws) that may lock the anti-scatter grid to the detector array. In yet another example, the coupling device includes an adhesive that allows the detector array to be adhered to a surface of the detector array.

The finished anti-scatter grid may then be inserted between an examination region of the radiation scanner (e.g., wherein an object to be scanned is inserted) and a detection region of the radiation scanner. The anti-scatter grid may then be attached to a detector array and/or another portion of an object scanning apparatus and used to attenuate secondary radiation. In this way, the anti-scatter grid may reduce the noise in signals generated by the detector array and/or improve the quality of images produced by a scanner (e.g., a computed tomography scanner) for example.

The method 1000 ends at 1006.

What is claimed is:

1. A computed-tomography (CT) system, comprising:

an examination surface configured to translate an object in a first direction during an examination of the object by the CT system;

a radiation source having a focal spot that moves in the first direction;

a detector array; and an anti-scatter grid disposed between the radiation source and the detector array and comprising:

an attachment edge for mounting the anti-scatter grid to the detector array, the attachment edge having a first height measured in a second direction perpendicular to the first direction and extending from a center of the detector array to the radiation source; and a plurality of anti-scatter plates having a second height different than the first height, wherein the plurality of anti-scatter plates are spatially offset from the attachment edge in a direction perpendicular to the first direction, and wherein each anti-scatter plate of the plurality of anti-scatter plates comprises:

a stalk portion; and a base portion, wherein:

a width of the stalk portion, as measured in the first direction, is sized relative to a width of the base portion, as measured in the first direction, such that radiation shadows cast by the stalk portion due to the focal spot moving in the first direction impinge a top surface of the base portion and do not impinge the detector array.

2. The CT system of claim 1, wherein:

the focal spot further moves in a third direction perpendicular to the first direction; and a length of the stalk portion, as measured in the third direction, is sized relative to a length of the base portion, as measured in the third direction, such that radiation shadows cast by the stalk portion due to the focal spot moving in the third direction impinge the top surface of the base portion and do not impinge the detector array.

3. The CT system of claim 2, wherein:

the length of the base portion is selected based upon a degree of movement by the focal spot in the third direction and a height of the stalk portion, measured in the second direction; and the width of the base portion is selected based upon a degree of movement by the focal spot in the first direction and the height of the stalk portion, measured in the second direction.

4. The CT system of claim 1, wherein the width of the base portion is selected based upon a degree of movement by the focal spot in the first direction and a height of the stalk portion, measured in the second direction.

5. The CT system of claim 1, wherein the base portion partially overlaps a pixel of the detector array.

6. The CT system of claim 5, wherein a first portion of a gap between the pixel and a second pixel is partially overlapped by the base portion and a second portion of the gap is not overlapped by the base portion.

7. The CT system of claim 1, wherein the base portion and the stalk portion are seamlessly connected.

8. The CT system of claim 1, wherein the stalk portion and the base portion comprise a tungsten.

9. The CT system of claim 1, wherein the stalk portion and the base portion comprise a lead.

10. The CT system of claim 1, wherein the attachment edge and the plurality of anti-scatter plates do not overlap in the second direction.

11. The CT system of claim 1, wherein the stalk portion and the base portion comprise a same composition of materials.

12. The CT system of claim 1, wherein the width of the base portion, as measured at a top surface of the base portion, is greater than the width of the stalk portion, as measured at a bottom surface of the stalk portion in contact with the top surface of the base portion.

13. The CT system of claim 1, wherein the anti-scatter grid comprises a molded epoxy structure.

14. The CT system of claim 1, wherein:

the plurality of anti-scatter plates are arranged to define a plurality of openings, at a top surface of the anti-scatter grid facing the radiation source each opening of the plurality of openings have a first width and a first length; and at a bottom surface of the anti-scatter grid facing the detector array each opening of the plurality of openings have a second width less than the first width and a second length less than the first length.

15. A computed-tomography (CT) system, comprising:

an examination surface configured to translate an object in a first direction during an examination of the object by the CT system;

a radiation source;

a detector array; and an anti-scatter grid disposed between the radiation source and the detector array and comprising:

an attachment edge for mounting the anti-scatter grid to the detector array; and a plurality of anti-scatter plates, wherein the plurality of anti-scatter plates are spatially offset from the attachment edge in a direction perpendicular to the first direction, and wherein:

the plurality of anti-scatter plates are arranged to define a plurality of openings;

at a top surface of the anti-scatter grid facing the radiation source each opening of the plurality of openings have a first width and a first length; and at a bottom surface of the anti-scatter grid facing the detector array each opening of the plurality of openings have a second width less than the first width and a second length less than the first length.

16. The CT system of claim 15, wherein the attachment edge has a first height measured in a second direction perpendicular to the first direction and extending from a center of the detector array to the radiation source, and wherein the plurality of anti-scatter plates has a second height different than the first height.

17. The CT system of claim 15, wherein:

the radiation source has a shifting focal spot; and dynamic radiation shadows created by the shifting focal spot are casts on base portions of the plurality of anti-scatter plates.

18. The CT system of claim 15, wherein each anti-scatter plate of the plurality of anti-scatter plates comprises:

a stalk portion defining the top surface of the anti-scatter grid; and a base portion underlying the stalk portion and defining the bottom surface of the anti-scatter grid.

19. The CT system of claim 18, wherein the base portion and the stalk portion are seamlessly connected.

* * * * *